US007137854B2

(12) United States Patent
Casses et al.

(10) Patent No.: US 7,137,854 B2
(45) Date of Patent: Nov. 21, 2006

(54) SINGLE-PIECE FEMALE ELECTRIC CONTACT TERMINAL HAVING REINFORCED TRANSITION PART

(75) Inventors: Claude Casses, Clevilliers (FR); Gérard Mulot, Nogent le Roi (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/517,243

(22) PCT Filed: Jun. 10, 2003

(86) PCT No.: PCT/EP03/50219

§ 371 (c)(1),
(2), (4) Date: Jul. 11, 2005

(87) PCT Pub. No.: WO03/105281

PCT Pub. Date: Dec. 18, 2003

(65) Prior Publication Data

US 2006/0141873 A1 Jun. 29, 2006

(30) Foreign Application Priority Data

Jun. 11, 2002 (FR) ..... 02 07174

(51) Int. Cl.
*H01R 11/22* (2006.01)

(52) U.S. Cl. ..... 439/852; 439/856

(58) Field of Classification Search ..... 439/852, 439/851, 853–857

See application file for complete search history.

(56) References Cited

U.S. PATENT DOCUMENTS

| | | | | |
|---|---|---|---|---|
| 4,030,804 | A * | 6/1977 | Enomoto | 439/884 |
| 4,880,401 | A * | 11/1989 | Shima et al. | 439/746 |
| 5,860,836 | A * | 1/1999 | Ohno | 439/752.5 |
| 5,879,205 | A | 3/1999 | Egenolf et al. | 439/852 |
| 5,899,775 | A * | 5/1999 | Davis et al. | 439/748 |
| 5,951,339 | A * | 9/1999 | Chaillot et al. | 439/852 |
| 5,971,816 | A * | 10/1999 | Chaillot | 439/852 |
| 6,095,874 | A * | 8/2000 | Quaranta | 439/852 |
| 6,524,142 | B1 * | 2/2003 | Heimueller | 439/852 |
| 2001/0053630 | A1 * | 12/2001 | Shi et al. | 439/607 |

FOREIGN PATENT DOCUMENTS

| | | |
|---|---|---|
| EP | 0 812 034 A1 | 12/1997 |
| EP | 0 959 531 A2 | 11/1999 |
| EP | 0 959 531 A3 | 11/1999 |

* cited by examiner

*Primary Examiner*—Hien Vu
(74) *Attorney, Agent, or Firm*—Harrington & Smith, LLP

(57) ABSTRACT

The invention relates to a female electrical contact terminal obtained from a single plate of electrically conductive metal including a rear part making possible a crimped connection with an electrical wire, a front part including a cage 4*a* consisting of a bottom, a top, two sides, at least one strip ensuring a contact with a complementary male contact terminal, a transition part linking the front part with the rear part, an extension leg at least traversing the transition zone.

18 Claims, 4 Drawing Sheets

SINGLE-PIECE FEMALE ELECTRIC CONTACT TERMINAL HAVING REINFORCED TRANSITION PART

FIELD OF THE INVENTION AND PRIOR ART

The invention relates to a female electrical contact terminal made in one piece from a stamped and bent sheet metal, intended to receive a complementary male contact terminal.

The invention finds applications in the field of electrical and electronic connectors and, in particular, in the field of connectors devoted to the automobile industry.

In the field of connectors, there is an effort to make connectors that are increasingly less expensive. To this end, there is an effort to design connectors that necessitate, on the one hand, the smallest amount of material possible and, on the other hand, the simplest fabrication possible. In order to meet these demands, it is known to produce female or male connectors or contact terminals in one piece from a single plate of sheet metal or of electrically conductive metal, referred to as metal foil, which is stamped and bent to form the desired connector.

In particular, female electrical contact terminals of the cage type are produced. Such a contact terminal consists of a rear part in which an electrical wire is fixed by crimping to connect it with another electrical wire fixed in a complementary male contact terminal. This female contact terminal also consists of a front part in the form of a cage, which is intended to receive the male contact terminal, and a transition part linking the front part with the rear part.

Such a female contact terminal is described in the patent application EP A 0 959,531. The cage of this contact terminal is made from a metal plate in which a bottom part, two sides (or lateral walls) and a top part are stamped and formed. The top part is made of two parts placed side to side. A tab is stamped and bent in the side to form the contact strip by means of which electrical contact is established between the female terminal and the complementary male terminal. In this female contact terminal, each element is made "as a single wall"; that is, each side of the contact terminal consists of only a single thickness of metal. In particular, the sides of the cage each consist of a single wall provided with an opening and an electrical contact strip placed across this opening. The top part is made of two parts positioned side by side. Owing to its being made as a single wall, the cage of this contact terminal affords a significant risk of crushing, particularly when the contact terminal is handled during production. Moreover, this construction as a single wall makes the contact terminal very fragile in narrow places and, in particular, in the region of intersection of cutting lines. In fact, owing to the stamping, forming, and bending of the sheet metal of small thickness, the intersections of the cutting lines can shear off and/or tear off under the effect of a lateral mechanical force exerted on a wall or parallel to this wall. This risk is particularly high in the thin zones, such as the transition zone between the rear part of the crimping of the electrical wire and the cage of the front part of the contact terminal.

These drawbacks become particularly important when, for economic reasons, manufacturers reduce the thickness of the sheet metal with the aim of reducing the costs of fabricating contacts.

To solve this problem, the applicant has created a female electrical contact terminal of the cage type in which the sides of the cage are extended in the part near to the transition zone. Such a contact terminal is described in the patent application filed in the name of the applicant under the number EP A 0 812,034.

The contact terminal described in this patent application comprises a rear part in which is crimped an electrical wire, a front part in the form of a cage intended to receive a complementary male connector, and a transition part linking the front part and the rear part. The cage of this contact terminal comprises a bottom, a top formed of two parts placed side by side, and two sides, each provided with an opening and a bend forming a shoulder for the male contact when the latter is introduced into the female contact terminal.

In this female contact terminal, each side extends up to the beginning of the transition part by way of a branch in the shape of a square. This extension of the sides of the cage makes it possible to create a reinforcement between the transition part and the cage itself, which rigidifies this zone situated in the region of the line of intersection between the cage and the transition zone, which is referred to as a junction trapezoid. In other words, the intersection of the cutting lines of the cage and the beginning of the transition part (in contrast to the end of the transition part, which is contiguous to the part behind the crimping) is reinforced by these branches, which extend the sides of the cage.

However, this reinforcement does not make it possible to reinforce the transition part itself. On the contrary, the end of the transition part, situated in the vicinity of the rear part, is made increasingly more fragile as the beginning of the transition part is reinforced. Thus, in the case of a mechanical force, the contact terminal that has just been described has little risk of shearing off or tearing off at the beginning of the transition zone, because it is reinforced there; by contrast, this rigidity introduces a fragility into the remainder of the transition part and particularly in the vicinity of the rear part.

The contact terminal described in the application EP A 0 812,034 comprises, in addition, two tabs stamped in the extension of the parts forming the top and bent into the interior of the cage in order to form contact tabs. Each of these tabs constitutes a second thickness of the lateral wall, which rigidifies the sides of the cage.

However, the creation of these contact strips from the parts forming the top necessitates the existence of a notch in each of the parts forming the top. The top of this contact terminal is thereby made fragile, particularly in the front part of the top, that is, the part introduced first into the male contact. In the event of poor manipulation of the female and male terminals, the top of the female terminal can be crushed.

DISCLOSURE OF THE INVENTION

The invention has the very object of remedying the drawbacks of electrical contact terminals described above. To this end, the invention proposes a female electrical contact terminal made of one piece, in which at least one of the parts forming the top of the contact cage extends as a leg traversing the entire transition part. In addition, the sides of the cage are double-walled, the contact strip forming the second thickness of each side.

More precisely, the invention relates to a female electrical contact terminal that is obtained from a single plate of electrically conductive metal comprising:

- a rear part that permits a crimped connection with an electrical wire, a front part consisting of a cage 4*a* comprising a bottom, a top, two sides, at least one strip ensuring a contact with a complementary male contact terminal, a transition part linking the front part with the rear part, characterized in that the top has at least one extension leg traversing the transition zone.

DETAILED DESCRIPTION OF EMBODIMENT OF THE INVENTION

Figure 1:
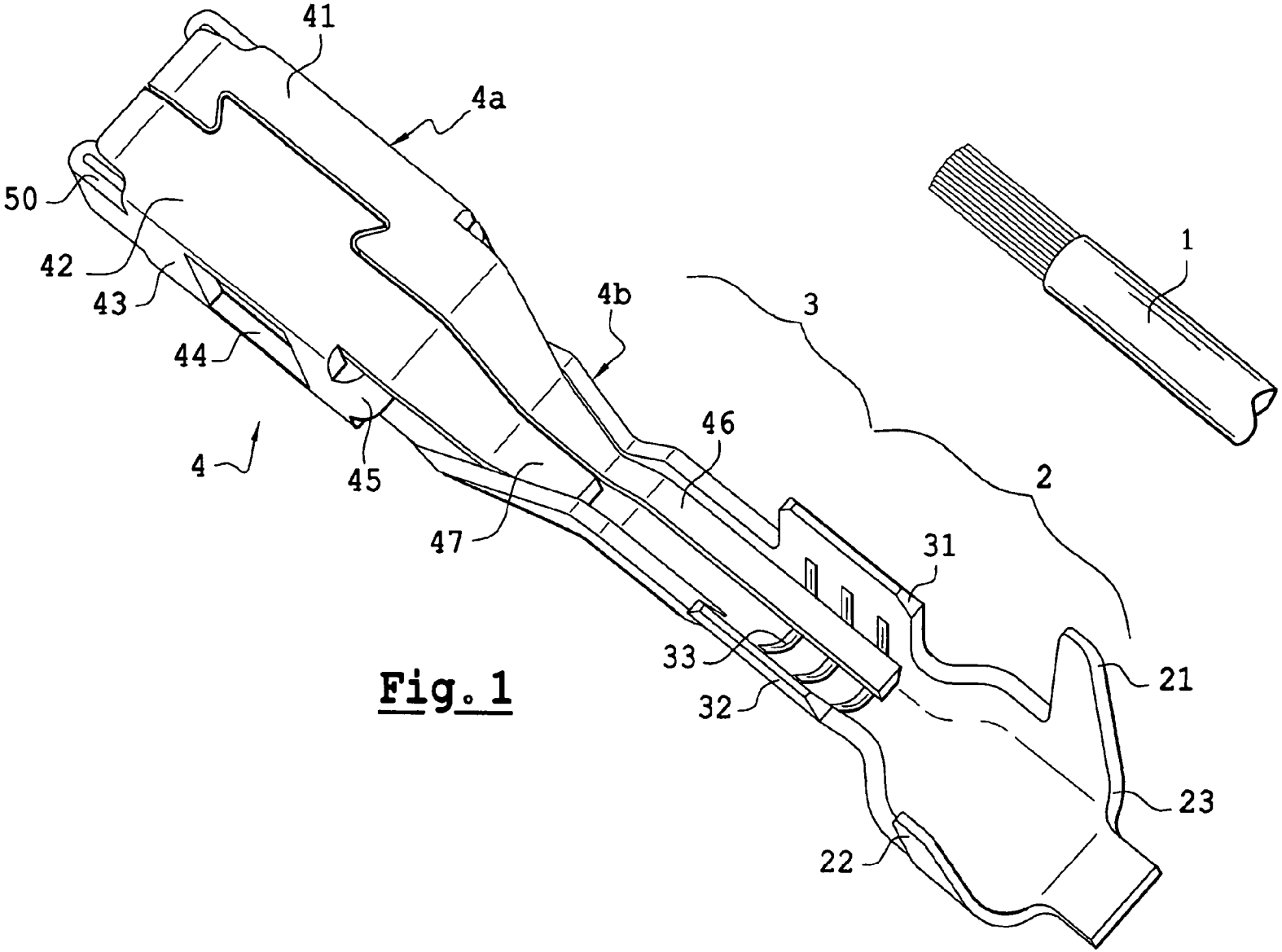
FIG. 1 represents the female electrical contact terminal in accordance with the invention before the electrical wire has been crimped.

FIG. 1 represents a profile view from above of a female electrical contact terminal in accordance with the invention. In FIG. 1, the contact terminal, viewed from above, is represented as being ready to be crimped around an electrically conductive wire 1.

The female contact terminal of the invention has dimensions and an outer form identical to that of female contact terminals of the prior art. Thus, it can be inserted into a classical male contact terminal, known to the person skilled in the art. The male contact terminal complementary to the female contact terminal of the invention will therefore not be described here.

The female contact terminal of the invention comprises a rear part 2, a front part 4, and a transition part 3 linking the front part 4 with the rear part 2.

The rear part 2 receives an electrical wire 1 intended to be connected to another electrical wire, crimped in a male contact terminal complementary to the female contact terminal of the invention. This rear part 2 comprises a bottom 23 as well as two lateral walls 21 and 22 of complementary shape, which form crimp pieces. These walls 21 and 22 are represented as being opened in FIG. 1, that is, as being in the position in which they are found after bending of the sheet metal forming the contact terminal, but before crimping of the electrical wire 1. These walls 21 and 22 are bent back and crimped around the insulator of the electrical wire 1 in order to hold it in fixed position in the contact terminal. One thus says that the electrical wire 1 is crimped in the contact terminal.

The rear part 2 comprises two other walls or crimp pieces 31 and 32, forming crimp pieces for the conductive part of the wire 1.

The front part 4 of the contact terminal comprises a cage 4*a* and a junction zone 4*b*, referred to as a junction trapezoid, situated between the cage 4*a* and the transition part 3. The cage 4*a* comprises a top formed from two parts 41 and 42, assembled together to form an essentially planar surface. In a preferred embodiment of the invention, the two parts 41 and 42 fit one into the other, thus rigidifying the top of the cage 4*a*. For example, the part 42 of the top can have a projecting part that forms a tenon and the part 41 of the top can have a notch that forms a mortise, which receives the tenon of the part 42.

As represented in FIG. 1, the part 41 of the top is extended by an extension leg 46, which traverses the entire transition part 3. In the embodiment represented in FIG. 1, the extension leg 46 ends at the rear of the transition part in the vicinity of the rear part 2 of the contact terminal. In another embodiment, the extension leg 46 traverses totally the transition part 3 and ends in the rear part 2. In this case, it can be positioned between the crimp pieces 31 and 32 of the conductive part of the wire 1.

In the embodiment of FIG. 1, only the part 41 of the top extends into the rear part 2. The part 42 of the top is terminated by a tab 47 in the junction trapezoid 4*b* at the beginning of the transition part 3. This junction trapezoid 4*b* constitutes the junction zone between the cage 4*a* and the transition part 3 of the contact terminal. It is formed, on the one hand, by the bottom of the front part 4 and, on the other hand, by the two top parts 41 and 42. It is thus double-walled, which makes it possible to rigidify this zone of the contact terminal.

In a variant of the invention, each part 41 and 42 of the top of the cage 4*a* comprises an extension leg 46. The two extension legs are thus preferably symmetrical with respect to each other and are of the same length.

The rear part 2 comprises a bottom 33 and two lateral walls 31 and 32. These walls 31 and 32 are represented as being open in FIG. 1, that is, not bent back toward the bottom 33, so as to show the extension leg 46 that traverses the transition part. When the sheet metal is entirely formed, these walls 31 and 32 are bent back toward the bottom 33 and the wall 31 surrounds the extension leg 46 of the part 41 of the top as well as the stripped conducting strands of the wire or cable 1. In this case, where each part 41 and 42 of the top has an extension leg, each wall 31 and 32 then surrounds one of the extension legs.

Figure 2:
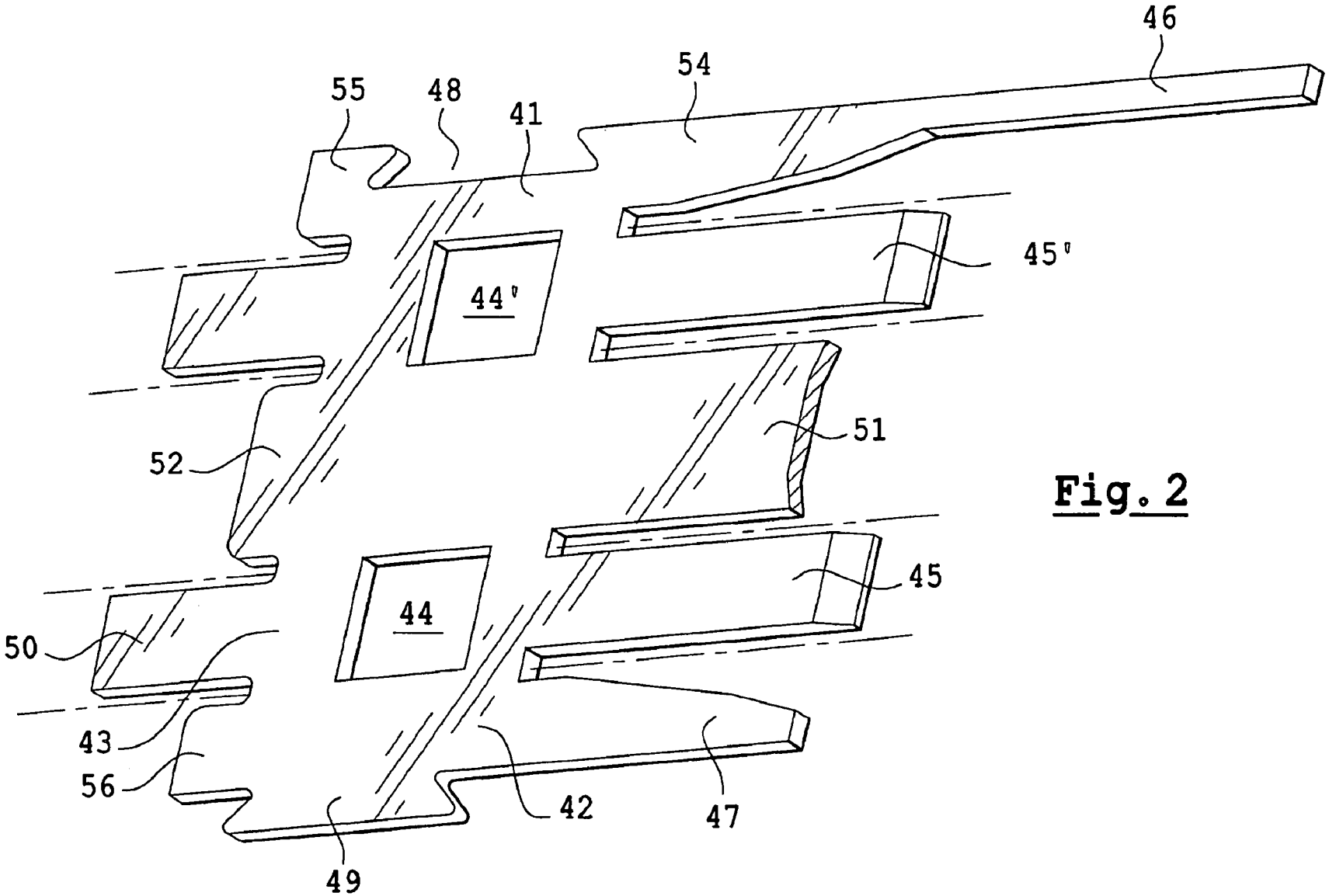
FIG. 2 represents a stamped sheet metal, intended to be bent for forming the contact terminal of FIG. 1.

FIG. 2 represents a sheet metal or plate of sheet metal or of an electrically conductive metal, which is stamped so as to be bent for forming a female contact terminal in accordance with the invention. Visible in FIG. 2, in particular, are the stampings made in the sheet metal for forming the front part of the contact terminal. It is to be noted that the transition part and the rear part of the contact terminal are identical to those of the connector described in the application EP A 0 812,034. The stampings of the sheet metal for making this transition part and this rear part are identical to those shown in the prior art; their description is therefore included in this text by incorporation of reference.

The stamped sheet metal thus comprises a bottom 51, sides 50 and 50', and two top parts 41 and 42. Represented by dot-dash lines for a better understanding of the invention are the places where the sheet metal will be bent at the time the contact terminal is formed.

The bottom 51 has a rectangular shape, slightly cut out in its part intended for forming the front part of the contact terminal. In order to simplify the figure, the bottom 51 has been represented solely in its part intended for forming the front part of the contact terminal. This bottom 51 comprises a single stamping, in front, for making the reinforcement tab 52. This tab 52, the width of which is approximately three times greater than its length, will be bent back during the bending of the sheet metal, at an angle of 15 to 20 degrees toward the interior of the cage 4*a* in order to create a reinforcement at the edge of the contact terminal and to facilitate the insertion of the male contact terminal when the male contact terminal and the female contact terminal are inserted into each other.

Located on each side of the bottom 51 is a side 43 or 43'. The two sides 43 and 43' are identical to each other. As a result, only the side 43 will be described here. This side 43 has an opening 44, intended to receive a locking pin of the terminal in a socket of a connection box receiving this terminal.

During the stamping of the opening 44, exclusively three sides of the opening can be stamped, the rear side of the opening, that is, the side nearest to the rear tab or contact strip 45 is not stamped. The part of the sheet metal bent back in the interior of the opening can then be used for pretensioning the contact strip 45 after bending toward the axis of the receiving cage of a contact pin or for constituting a stop for this strip, limiting its deformation in the case when a pin of too great a cross section is introduced or in the case when a pin is introduced at an angle. This stop can be made by bending back the stamped part of the sheet metal, in one or more bends, on the interior of the cage toward the rear of the cage. This stop constitutes a safety feature when the male pin is inserted into the female terminal.

The side 43 contains, in addition, a first tab 45, referred to as a rear tab. This rear tab 45 is stamped in the sheet metal between the opening 44 and the rear of the contact terminal. During the bending of the sheet metal, the rear tab 45 is bent toward the interior of the cage 4*a*, from the rear toward the front, at an angle of approximately 180 degrees. This tab 45 forms a contact strip of the contact terminal of the invention. It also forms a double wall of the side 43. In addition, this rear tab 45 is placed, in the interior of the cage 4*a*, along the opening 44.

Such an embodiment of the contact strip, stamped and formed in the side 43 of the contact terminal, makes it possible to obtain a contact strip that is narrower than in the prior art but more rigid, because it constitutes the double wall of the side.

For a better electrical contact, the tab 45 can be bent back when it is formed, in such a way as to form a shoulder 53 of contact with the complementary pin.

The side 43 contains a second tab 50, referred to as a front tab, situated on the other side of the orifice 44 in relation to the rear tab 45. When the sheet metal is formed, this front tab 50 is bent toward the interior of the cage 4*a* from the front toward the rear at an angle appreciably less than 180 degrees—for example, 160 degrees. This front tab 50 has a length that is less than that of the rear tab 45, being on the order of half thereof. The front tab 50 is bent on top of the rear tab 45 in such a way that the end of the rear tab 45 is a support against the front tab 50. The front tab 50 ensures a flexible support of the contact strip formed by the tab 45 in order to afford a precise value of the gap between the strips 45 and 45' in the region of the zones of contact with the complementary pin, in order to pretension the strips, and to guide the pin during its insertion.

The ends of the tabs 50 and 45 can be stamped at a right angle, that is, perpendicularly to the surface of said tabs, or else at a bevel in order to adjust the overlap of these two tabs.

The side 43' is identical to the side 43. It comprises the same elements as the side 43, namely, the opening 44', the rear tab 45', and the front tab 50', the bends and roles of which are identical to those described for the side 43. The invention is applicable to a contact provided with a single strip 45.

Each side 43 and 43' is contiguous to a top part 41 or 42. More precisely, in FIG. 2, the side 43 is contiguous to the top part 42 and the side 43' is contiguous to the top part 41. As explained above, after the sheet metal is folded, the parts 41 and 42 are placed side by side and assembled to form the top of the front part 4 of the female contact terminal.

In a preferred embodiment of the invention, the parts 41 and 42 have complementary shapes, which make it possible for one to fit into the other in order to rigidify the top. For example, the free side (opposite to the side contiguous to the side wall) of one of the parts of the top is stamped to form a tenon and the free part of the other part of the top is stamped to form a mortise. The free parts of the two parts of the top can also be stamped to form zigzags that are complementary to each other.

In the example of FIG. 2, the free side of the part of the top 41 contains a stamping forming a mortise 48 and the free part of the part of the top 42 contains a projection forming a tenon 49 that fits into the mortise 48 during the bending of the sheet metal.

In the embodiment of FIG. 2, the top part 41 contains an extension leg 46, which, after bending of the sheet metal, is bent back toward the bottom 51 of the front part. More precisely, during the bending of the sheet metal, the extension leg 46 can be bent a first time at the junction between the cage 4*a* and the junction trapezoid 4*b* and then bent a second time at the junction trapezoid 4*b* and the transition part 3. After this second bending, the extension leg 46 is situated along the bottom 33 of the transition part 3.

Figure 5:
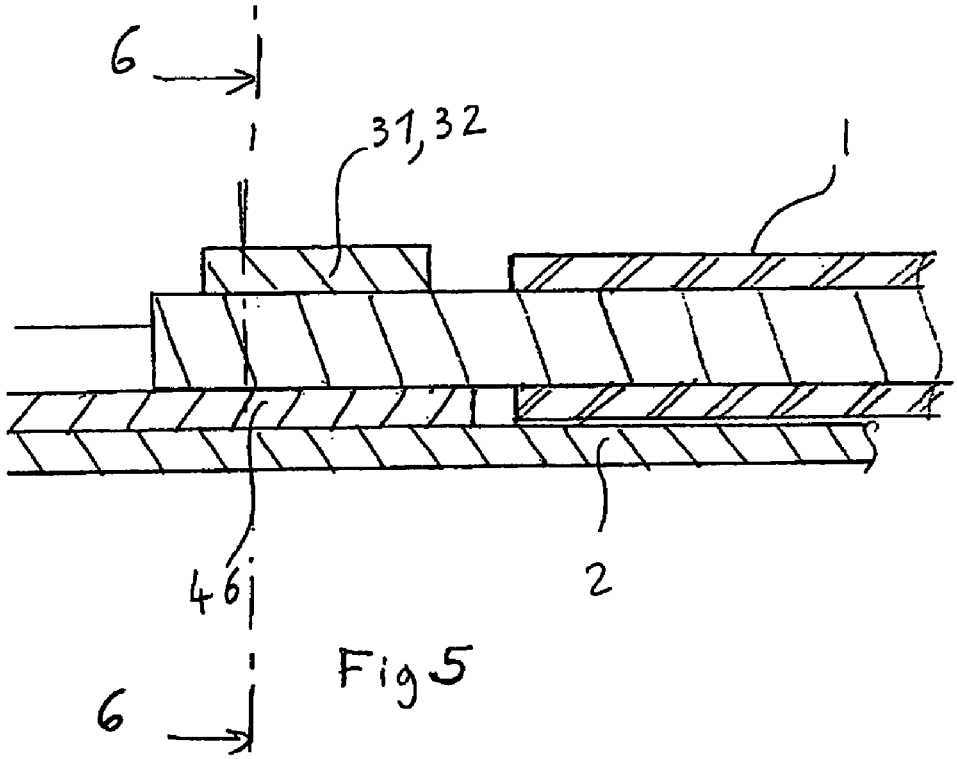
FIG. 5 is a cross sectional view of the extension leg 46 extending between the crimp pieces and is crimped to the wire.
Figure 6:
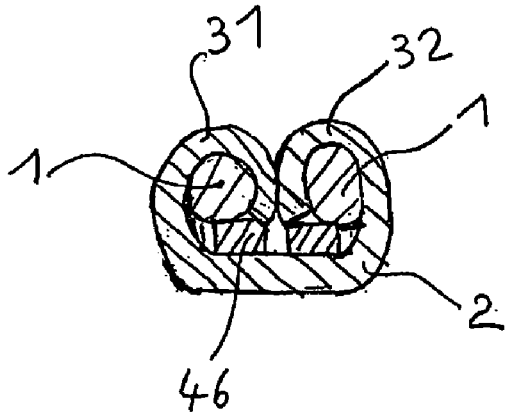
FIG. 6 is a cross sectional view of the members shown in FIG. 5 taken along line 6—6.

As seen in FIGS. 5 and 6, in an embodiment of the invention, the extension leg 46 can extend up to the interior of the rear part 2 and be received in the crimping zone of the conductive wire. The extension leg extends between the crimp pieces of the electrical wire and is crimped with the wire.

The intercalary zone 54 of the sheet metal situated between the mortise 48 and the extension leg 46 has essentially the shape of a right-angled triangle that is terminated by the extension leg, with a straight part that is parallel to the bottom 51 and an angled part that allows this zone 54 to be lodged in the junction trapezoid 4*b*.

The part of the top 42 is terminated by an intercalary zone 47 that is symmetrical to the intercalary zone 54.

As explained above, the top part 42 can also consist of an extension leg, which is symmetrical to the extension leg 46 of the part 41. This extension leg can have the same characteristics as those of the extension leg 46.

Figure 3:
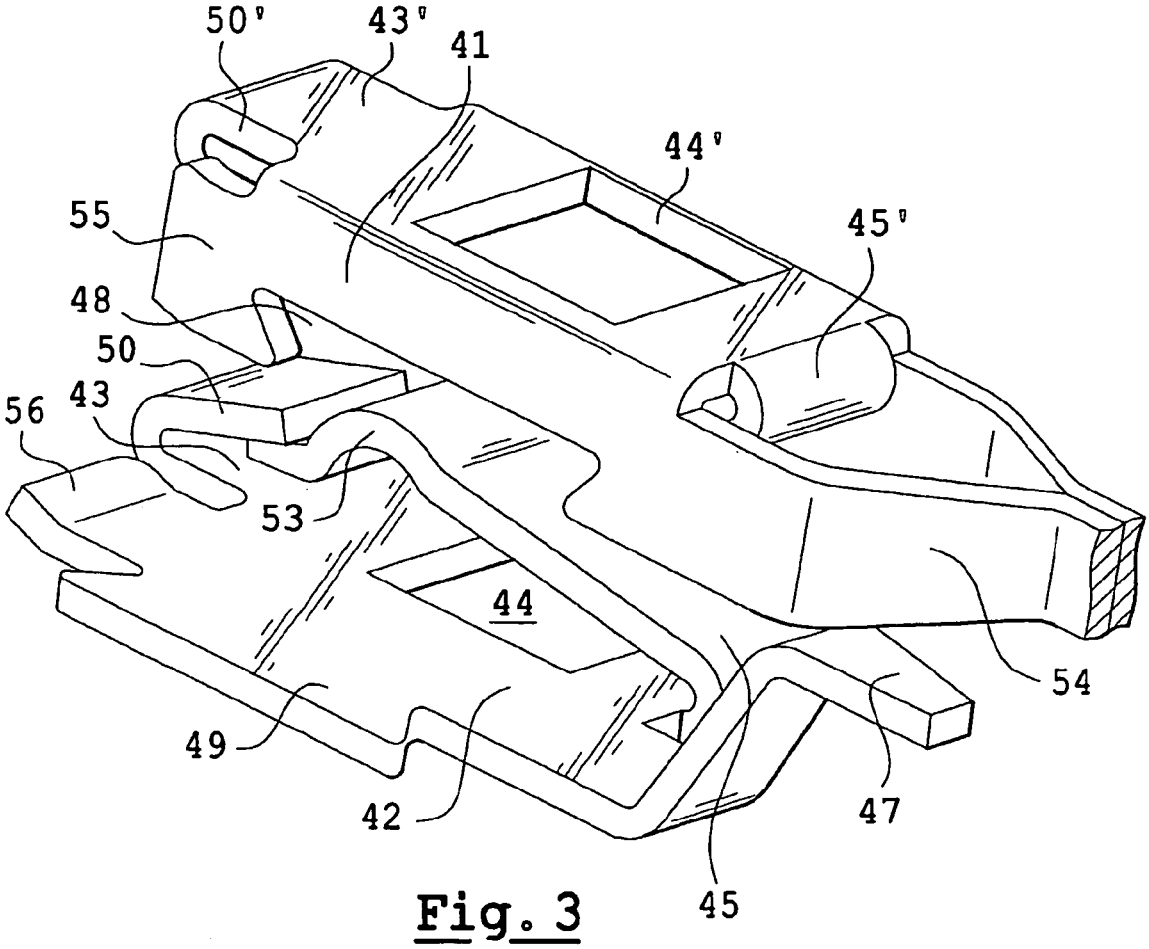
FIG. 3 represents the stamped sheet metal of FIG. 2, partially bent in order to form the cage of the contact terminal of the invention.

FIG. 3 shows the contact terminal of the invention during forming of the sheet metal. In FIG. 3, the contact terminal has been represented in profile in a view rotated by 90° in relation to the view of FIG. 1. The bottom 51 of the front part 4 is thus not visible in this FIG. 3. By contrast, this figure shows quite well the interior of the cage 4*a*. Thus, this figure shows the side 43' of the contact terminal of the invention with its opening 44' and its rear tab 45' and front tab 50' bent back. This FIG. 3 also shows the top part 41, bent at a right angle in relation to the side 43', with its intercalary zone 54 and its end 55 bent toward the interior of the cage 4*a*.

This FIG. 3 also shows the other side of the front part 4 in the course of bending. Seen here is the rear tab 45 bent back toward the front with a bend forming a shoulder 53, the front tab 50 bent back on top of the rear tab 45, and the intercalary zone 47 bent in order to enter the junction trapezoid.

In this FIG. 3, the top part 42 has not yet been bent toward the other part of the top 41. This bending is the final bending to be carried out in order for the front part 4 to be formed.

Figure 4:
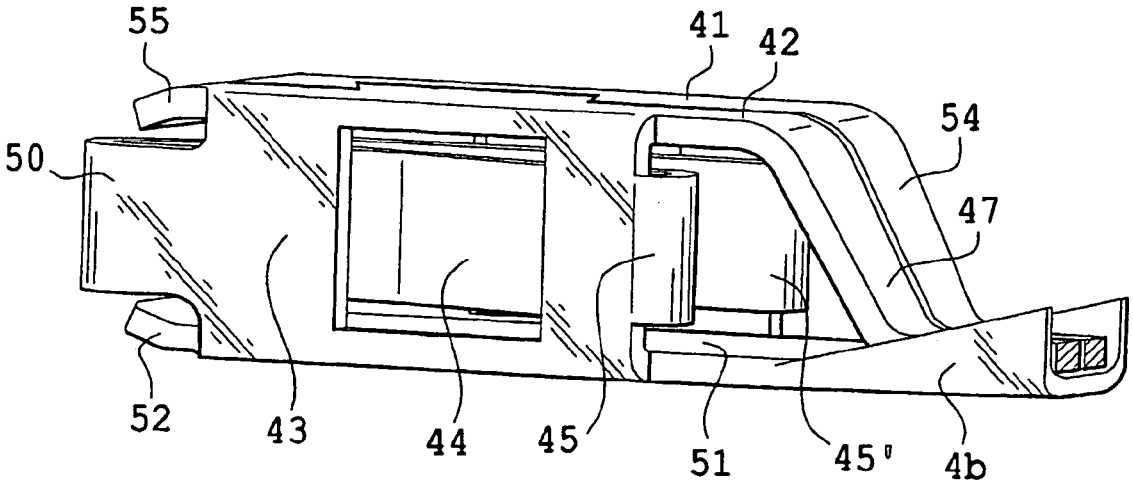
FIG. 4 represents the stamped sheet metal of FIG. 2, totally bent in order to form the cage of the contact terminal of the invention.

FIG. 4 represents a side view, in profile, of the front part of the contact terminal of the invention. This figure shows the contact terminal when the sheet metal is entirely formed. Seen here is the side 43 with its opening 44, traversing which is visible the contact strip 45 supported by the front tab 50. This figure also shows the inclination of the ends 55 and 52, respectively, of the top 41/42 and of the bottom 51 as well as the inclination of the intercalary zones 54 and 47 of the parts 41 and 42 of the top. Also visible in this FIG. 4 is the junction trapezoid 4*b* formed in the extension of the bottom 51 of the front part 4 and the intercalary zones placed in this trapezoid 4*b*.

The contact terminal that has just been described has the advantage of being able to be produced in a sheet metal of dimensions equal to or less than those sheet metals of the prior art, while being rigidified by double walls and the extension of the top augmenting the section of the transition zone as well as the section of current passage when at least one extension leg is taken up in the crimping zone for the conductive wire. In fact, in the invention, the initial sheet metal (before being stamped) has a relatively compact form with a length equal to the length of the final contact terminal and a width equal to twice the dimensions for one side and the bottom of said contact terminal.

In addition, the stampings made in the sheet metal produce little material that is unused and thus is lost or needs to be recycled. The reinforcements, such as the extension leg or the double walls of the sides, are created integrally in the sheet metal without the addition of material. In particular, the extension leg, which constitutes the double wall of the transition zone, is made in a part of the sheet metal that, in the prior art, was not used.

The invention claimed is:

1. A female electrical contact terminal obtained from a single plate of electrically conductive metal comprising:

a rear part having crimp pieces to make a crimped connection with an electrical wire, a front part comprising a cage comprising a bottom, a top, and two sides, at least one strip extending from at least one of the two sides of the front part into the cage to make a contact with a complementary male contact terminal, a transition part forming a transition zone connecting the front part with the rear part, wherein the top has at least one extension leg extending along a longitudinal length of the transition part, wherein the at least one extension leg extends between the crimp pieces and is crimped with the electrical wire.

2. The contact terminal according to claim 1, wherein the top has two assembled parts, one of said parts containing at least the extension leg.

3. The contact terminal according to claim 2, wherein each part of the top contains an extension leg.

4. The contact terminal according to claim 2, wherein the extension leg enters the rear part.

5. The contact terminal according to claim 2, wherein the top comprises two parts which fit into each other.

6. The contact terminal according to claim 5, wherein one of the parts of the top forms a tenon and the other part of the top forms a mortise.

7. The contact terminal according to claim 1, wherein the at least one strip comprises a first tab, bent back toward the interior of the cage from the rear toward the front.

8. The contact terminal according to claim 7, wherein the sides of the front part each contain a second tab bent back toward the interior of the cage from the front toward the back on top of the first tab.

9. A one-piece female electrical contact terminal comprising:

a rear part having crimp pieces to fixedly connected to an electrical conductor;

a front part comprising a cage including a bottom, a top, and two sides;

at least one strip extending from at least one of the two sides of the front part to make a contact with a complementary male contact terminal; and a transition part forming a transition zone connecting the front part with the rear part, wherein the top has at least one extension leg extending along a longitudinal length of the transition part, wherein the at least one extension leg extends between the crimp pieces to be crimped with the electrical conductor.

10. The contact terminal according to claim 9 wherein the top has two assembled parts, and wherein one of the assembled parts comprises the extension leg.

11. The contact terminal according to claim 10, wherein each assembled part of the top comprises the at least one extension leg.

12. The contact terminal according to claim 10, wherein at least one of the extension legs extends to the rear part.

13. The contact terminal according to claim 9, wherein the top comprises two parts which fit into each other.

14. The contact terminal according to claim 13 wherein one of the parts of the top forms a tenon and the other part of the top forms a mortise.

15. The contact terminal according to claim 9 wherein the at least one strip comprises a first tab, bent back toward the interior of the cage from the rear toward the front.

16. The contact terminal according to claim 15 wherein the sides of the front part each contain a second tab bent back toward the interior of the cage from the front toward the back on top of the first tab.

17. A one-piece electrical contact terminal comprising:

a rear part having crimp pieces to fixedly connect to an electrical conductor;

a front part comprising a cage having a top, a bottom, two sides, and at least one strip extending from at least one of the sides into the cage to be mated to a complementary mating contact terminal; and a transition part forming a transition zone connecting the front part with the rear part, wherein the front part comprises at least one extension leg extending along a majority of a longitudinal length of the transition part, wherein the transition part extends substantially to the rear part, wherein the at least one extension leg extends between the crimp pieces to be crimped with the electrical conductor.

18. The contact terminal according to claim 17 wherein the transition part extends at least partially along the rear part.

* * * * *